US006918804B2

(12) United States Patent
Matsuda

(10) Patent No.: US 6,918,804 B2
(45) Date of Patent: Jul. 19, 2005

(54) PERSONAL WATERCRAFT

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/692,778

(22) Filed: Oct. 24, 2003

(65) Prior Publication Data

US 2004/0127112 A1 Jul. 1, 2004

(30) Foreign Application Priority Data

Oct. 29, 2002 (JP) ..... 2002-314344

(51) Int. Cl.[7] ..... B63H 21/38; F02B 33/00

(52) U.S. Cl. ..... 440/88 A; 440/84; 440/88 R; 123/559.1; 60/598

(58) Field of Search ..... 440/1, 84, 88 R, 440/88 A, 3, 38; 114/55.5, 55.57; 123/559.1, 559.3, 562, 564, 565; 60/598, 607, 609, 612

(56) References Cited

U.S. PATENT DOCUMENTS 3,418,986 A * 12/1968 Scherenberg ..... 123/559.1
4,505,117 A * 3/1985 Matsuoka ..... 60/609
4,826,412 A * 5/1989 Kubo et al. ..... 418/180
4,903,488 A * 2/1990 Shibata ..... 60/609
4,951,638 A * 8/1990 Tsuboi et al. ..... 123/559.1
5,072,707 A * 12/1991 Takai et al. ..... 123/311
5,253,618 A * 10/1993 Takahashi et al. ..... 123/65 BA
5,261,356 A * 11/1993 Takahashi et al. ..... 123/41.31
5,293,846 A * 3/1994 Takahashi ..... 123/65 BA
5,911,211 A * 6/1999 Uchida ..... 123/559.1
6,055,967 A * 5/2000 Miyagi et al. ..... 123/564
6,059,618 A * 5/2000 Purnell et al. ..... 440/38
6,352,068 B1 * 3/2002 Jacobsen ..... 123/585
6,405,692 B1 * 6/2002 Christiansen ..... 123/65 BA
6,439,188 B1 * 8/2002 Davis ..... 123/193.2
6,568,376 B2 * 5/2003 Sonnleitner et al. ..... 123/559.1
6,612,747 B1 * 9/2003 Jones ..... 384/461
2004/0031636 A1 * 2/2004 Pichler et al. ..... 180/190

FOREIGN PATENT DOCUMENTS

JP 2001-146197 5/2001

* cited by examiner

*Primary Examiner*—S. Joseph Morano
*Assistant Examiner*—Ajay Vasudeva
(74) *Attorney, Agent, or Firm*—Alleman Hall McCoy Russell & Tuttle LLP

(57) ABSTRACT

A personal watercraft comprising a water jet pump, an engine for driving the water jet pump, and a mechanically driven supercharger provided independently of the engine and configured to draw taken-in air to the engine.

10 Claims, 5 Drawing Sheets

PERSONAL WATERCRAFT

BACKGROUND OF THE INVENTION

1. Field of the Invention

The present invention relates to a jet-propulsion personal watercraft (PWC).

2. Description of the Related Art

In recent years, jet-propulsion personal watercraft have been widely used in leisure, sport, rescue activities, and the like. The personal watercraft is equipped with an engine within a space surrounded by a hull and a deck. The personal watercraft is configured to have a water jet pump that pressurizes and accelerates water sucked from a water intake generally provided on a hull bottom surface and ejects it rearward from an outlet port of the water jet pump. As the resulting reaction, the personal watercraft is propelled forward.

In the jet-propulsion personal watercraft, a steering nozzle provided behind the outlet port of the water jet pump is swung either to the right or to the left by operating a bar-type steering handle to the right or to the left, to change the ejection direction of the water to the right or to the left, thereby turning the watercraft to right or to the left.

In the personal watercraft, various devices are made to gain a high power using the same engine body. As a prior art, Japanese Laid-Open Patent Application Publication No. 2001-146197 (pages 1 to 8, FIGS. 5 and 6) discloses a personal watercraft in which a turbocharger is mounted to efficiently gain a high power engine. The turbocharger is a supercharger, and is configured to rotate a built-in turbine using flow of an exhaust gas of the engine for air taken in from outside to be pressurized and to supply the pressurized air to the engine. With this configuration, a large amount of air is supplied to the engine, and thereby air-intake efficiency can be increased.

While traveling at high speeds in choppy water, the personal watercraft tends to frequently jump out of the water and land in the water. When the watercraft is jumping, the water jet pump rotates without water in the pump, thereby causing a load applied to the engine to rapidly decrease. Under this condition, since the engine runs at a high speed, the turbine of the turbo charger rotates at a high speed, thereby causing a supercharging pressure to rapidly increase.

The turbocharger is typically provided with a relief valve for air release to inhibit the supercharging pressure from excessively increasing. When the watercraft is jumping out of the water and the supercharging pressure becomes relatively high, the relief valve reduces the pressure of the air, so that the supercharging pressure is reduced when the watercraft lands in the water. Therefore, in the case where the watercraft frequently jumps out of the water and lands in the water, a rider typically opens a throttle valve after landing to allow the engine speed to increase, for the purpose of increasing the reduced supercharging pressure.

However, since the turbocharger pressurizes the taken-in air utilizing a turbine rotated by the flow of exhaust gas, an effect peculiar to turbochargers, referred to as "turbo lag," takes place, which causes delay in the response to the rider's throttle operation. Therefore, when the watercraft frequently jumps and lands in choppy water, the turbo lag takes place each time the watercraft lands and the rider opens the throttle valve. Consequently, when the personal watercraft in which the turbocharger is mounted travels in choppy water, it takes some time due to the turbo lag to increase a propulsion force after the watercraft lands.

SUMMARY OF THE INVENTION

The present invention addresses the above described conditions, and an object of the present invention is to provide a personal watercraft capable of inhibiting reduction of a propulsion force when the watercraft lands in water and of increasing a propulsion force smoothly according to a throttle operation of a rider when the watercraft lands in the water even when the watercraft frequently jumps out of the water and lands in the water.

According to the present invention, there is provided a personal watercraft comprising a water jet pump, an engine for driving the water jet pump, and a mechanically driven supercharger provided independently of the engine and configured to draw air taken in from outside to the engine.

In such a configuration, the mechanically driven supercharger, which does not utilize the flow of the exhaust gas as a drive source, can inhibit occurrence of the turbo lag and, therefore, the propulsion force can be quickly increased in response to the rider's throttle operation. In addition, since the engine and the supercharger, which become vibration sources, are mounted independently of each other, vibration in the entire watercraft can be reduced by controlling vibration modes of these components of the watercraft; for example, to allow vibrations to cancel each other.

In order to incorporate the supercharger into the engine, it becomes necessary to change the design of the engine, which leads to a high cost and a complex engine structure. On the other hand, by mounting the engine and the supercharger independently of each other, the personal watercraft can obtain the above described effects using the existing engine and the existing supercharger.

The personal watercraft may further comprise an air-intake box configured to temporarily store the air taken in from outside to be drawn to the engine, wherein the supercharger is contained within the air-intake box. Thereby, the supercharger becomes water-proof and hence rust-proof.

The personal watercraft may further comprise a transmission shaft configured to transmit an output of the engine to the water jet pump, wherein the supercharger may be driven in cooperation with rotation of the transmission shaft. In such a configuration, the supercharger provided independently of the engine can be driven in cooperation with the rotation of the transmission shaft.

The supercharger may be placed forward of or behind the engine. When placed behind the engine, the supercharger may be placed in the vicinity of the transmission shaft through which the engine is connected to the water jet pump. Such a structure makes it possible to easily gain a drive power of the supercharger from the transmission shaft. When placed forward of the engine, the supercharger may be placed in the vicinity of a front end portion of the crankshaft extended forward, or an extended shaft extended from the front end portion of the crankshaft. Such a structure makes it possible to easily gain the drive power of the supercharger from the crankshaft or the extended shaft.

The supercharger may have a rotor shaft for driving a built-in rotor of the supercharger, the rotor shaft may be placed to extend substantially in parallel with the transmission shaft, and the rotor shaft and the transmission shaft may be connected to each other through pulleys respectively provided on the shafts and a belt installed around the pulleys or through sprockets respectively provided on the shafts and a chain installed around the sprockets. In such a configuration, a rotational force generated by the engine can be transmitted to the supercharger by means of a simple structure comprised of the pulleys and the belt or the sprockets and the chain.

The personal watercraft may further comprise a coupling means configured to couple an output shaft of the engine to a pump shaft of the water jet pump, wherein the supercharger has the rotor shaft for driving the built-in rotor of the supercharger, the rotor shaft is provided with a driven pulley at an end portion thereof, and a drive pulley is provided integrally on the coupling means, the driven pulley on the rotor shaft being connected to the drive pulley on the coupling means through the belt. In such a configuration, it is not necessary to independently provide the pulley on the transmission shaft through which the engine is connected to the water jet pump. Instead, the pulley provided integrally on the coupling means can be used. As a result, the number of components is reduced and productivity is improved. It should be appreciated that the pulleys and the belt may be replaced by the sprockets and the chain.

The personal watercraft may further comprise a shaft casing that covers part of the transmission shaft within an engine room of the watercraft, wherein the supercharger may be placed on the shaft casing. In such a structure, the supercharger can be easily placed in the vicinity of the transmission shaft.

The engine may be a four-cycle engine. The four-cycle engine is suitable for use in the personal watercraft configured as described above.

The above and further objects and features of the invention will more fully be apparent from the following detailed description with accompanying drawings.

DETAILED DESCRIPTION OF THE PREFERRED EMBODIMENTS

Figure 1:
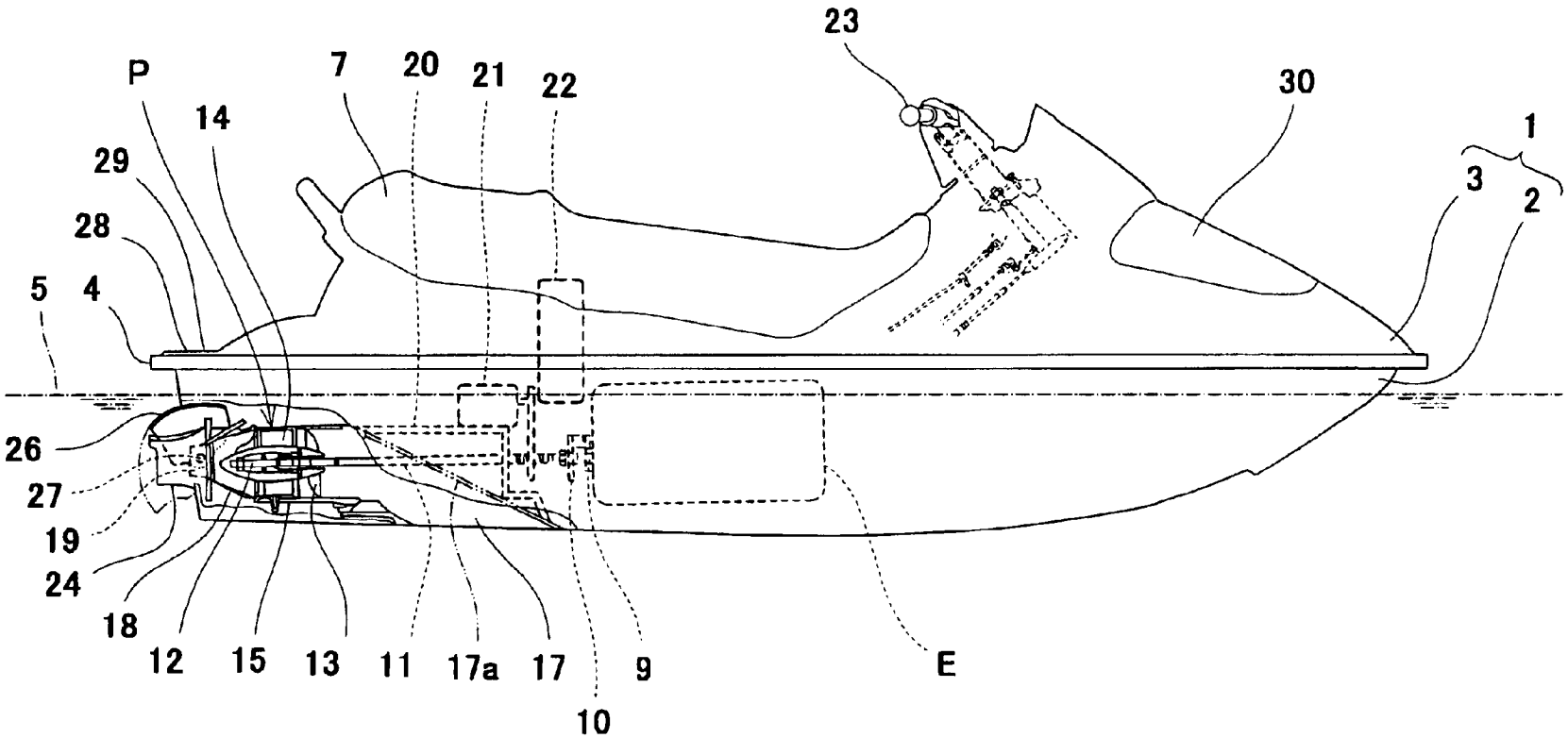
FIG. 1 is a side view of a personal watercraft according to an embodiment of the present invention.

Hereinafter, a personal watercraft according to an embodiment of the present invention will be described with reference to the accompanying drawings. The personal watercraft in FIG. 1 is a straddle-type personal watercraft provided with a seat 7 straddled by a rider. A body 1 of the watercraft comprises a hull 2 and a deck 3 covering the hull 2 from above. A line at which the hull 2 and the deck 3 are connected over the entire perimeter thereof is called a gunnel line 4. The gunnel line 4 is located above a waterline 5 of the watercraft.

Figure 2:
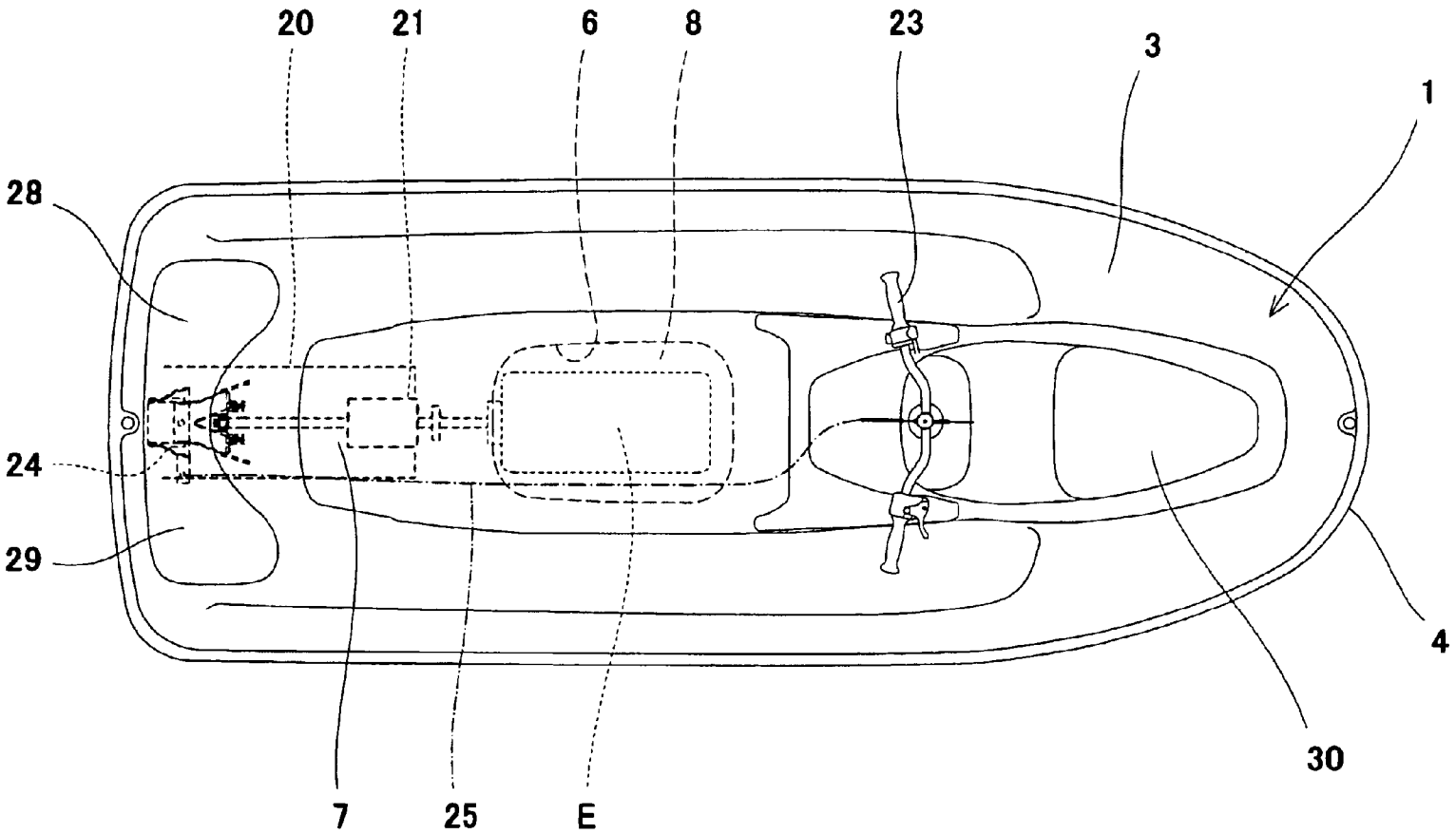
FIG. 2 is a plan view of the personal watercraft in FIG. 1.

As shown in FIG. 2, an opening 6, which has a substantially rectangular shape as seen from above is formed at a substantially center section of the deck 3 in the upper portion of the body 1 such that its longitudinal direction corresponds with the longitudinal direction of the body 1. The seat 7 is removably mounted over the opening 7. An engine room 8 is provided in a space defined by the hull 2 and the deck 3 below the opening 6. An engine E for driving the personal watercraft is mounted within the engine room 8. The engine room 8 has a convex-shaped transverse cross-section and is configured such that its upper portion is smaller than its lower portion. In this embodiment, the engine E is an in-line four-cylinder four-cycle engine. As shown in FIG. 1, the engine E is mounted such that a crankshaft 9 extends along the longitudinal direction of the body 1.

An output end of the crankshaft 9 is rotatably coupled integrally with a pump shaft 12 of a water jet pump P provided on the rear side of the body 1 through a propeller shaft (transmission shaft) 11. An impeller 13 is attached on the pump shaft 12 of the water jet pump P. Fairing vanes 14 are provided behind the impeller 13. The impeller 13 is covered with a pump casing 15 on the outer periphery thereof.

A water intake 17 is provided on the bottom of the body 1. The water intake 17 is connected to the pump casing 15 through a water passage 17*a*. The pump casing 15 is connected to a pump nozzle 18 provided on the rear side of the body 1. The pump nozzle 18 has a cross-sectional area that gradually reduces rearward, and an outlet port 19 is provided on the rear end of the pump nozzle 18.

The propeller shaft 11 penetrates a wall face of the water passage 17*a*. The propeller shaft 11 is exposed inside the body 1 between the engine E and the water passage 17*a*. A shaft casing 20 of the propeller shaft 11 is provided to cover a rear portion of the exposed portion of the propeller shaft 11 within the engine room 8. That is, the shaft casing 20 is formed to extend upwardly from a bottom of the hull and surround part of the propeller shaft 11. On the casing 20, a mechanically-driven supercharger 21 described later is mounted. An air cleaner box 22 is provided between the supercharger 21 and the engine E located forward of the supercharger 21. The air cleaner box 22 is substantially rectangular-parallelepiped shaped and has a hollow portion.

Water outside the watercraft is sucked from the water intake 17 and fed to the water jet pump P. The water jet pump P pressurizes and accelerates the water and the fairing vanes 14 guide water flow behind the impeller 13. The water is ejected through the pump nozzle 18 and from the outlet port 19 and, as the resulting reaction, the watercraft obtains a propulsion force.

In FIGS. 1 and 2, reference numeral 23 denotes a bar-type steering handle. The steering handle 23 is connected to a steering nozzle 24 provided behind the pump nozzle 18 through a cable 25 (indicated by a dashed line in FIG. 2). When the rider rotates the handle 23 clockwise or counterclockwise, the steering nozzle 24 is swung toward the opposite direction so that the ejection direction of the water being ejected through the pump nozzle 18 can be changed, and the watercraft can be correspondingly turned to any desired direction while the water jet pump P is generating the propulsion force.

As shown in FIG. 1, a bowl-shaped reverse deflector 26 is provided on the rear side of the body 1 and on the steering nozzle 24 such that it can vertically swing around a horizontally mounted swinging shaft 27. The deflector 26 is swung downward to a lower position around the swinging shaft 27 to deflect the ejected water from the steering nozzle 24 forward and, as the resulting reaction, the personal watercraft moves rearward.

In FIGS. 1 and 2, a rear deck 28 is provided in the rear section of the body 1. The rear deck 28 is provided with an openable rear hatch cover 29. A rear compartment with a small capacity is provided under the rear hatch cover 29. A front hatch cover 30 is provided in a front section of the body 1. A front compartment with a certain capacity is provided under the front hatch cover 30 for storing equipment and the like.

Figure 3:
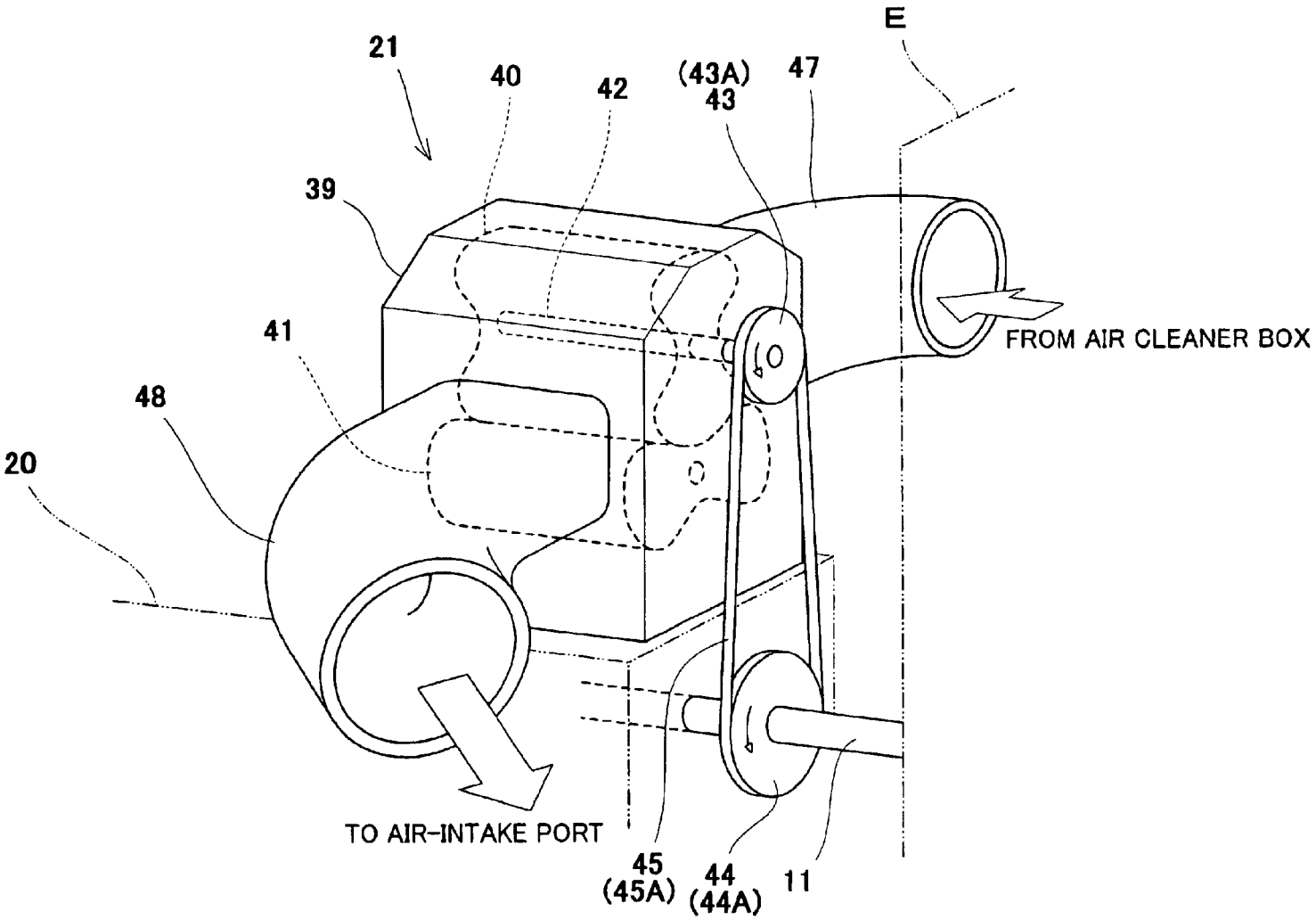
FIG. 3 is a schematic perspective view showing a configuration of a mechanically driven supercharger equipped in the personal watercraft in FIG. 1 and its peripheral devices.

Referring now to FIG. 3, the shaft casing 20 that covers the propeller shaft 11 is provided behind the engine E. The propeller shaft 11 penetrates a front face of the shaft casing 20. The supercharger 21 is placed on and fixed to a front side of an upper face of the shaft casing 20.

The supercharger 21 is mechanically driven according to an operation of the engine E. In this embodiment, the supercharger 21 is of Roots-blower type. In addition to the Roots-blower type supercharger, for example, a Lysholm-compressor type supercharger may be used. In this embodiment, the supercharger 21 comprises upper and lower rotors 40 and 41 placed in the vertical direction within an inner space of a rotor casing 39 of the supercharger 21. The rotors 40 and 41 are placed such that their rotational axes extend along the longitudinal direction (in parallel with the propeller shaft 11). The rotors 40 and 41 are driven in cooperation with each other. That is, the lower rotor 41 rotates in cooperation with the rotation of the upper rotor 40.

The upper rotor 40 has a rotor shaft 42 having a front end portion that protrudes forward from the rotor casing 39. A driven pulley 43 is attached coaxially on the front end portion of the rotor shaft 42. A drive pulley 44 is attached coaxially on a portion of the propeller shaft 11 exposed inside the body 1 and located right below the driven pulley 43. A belt 45 is installed around the driven pulley 43 on the supercharger 21 side and the drive pulley 44 on the propeller shaft 11 side. Through the belt 45, the pulleys 43 and 44 operate in cooperation with each other. This is called belt drive.

Instead of the belt drive, chain drive is achieved by replacing the pulleys 43 and 44 by sprockets 43A and 44A around which a chain 45A is installed. For the sake of convenience, in FIGS. 3 and 4, the sprockets 43A and 44A and the chain 45A are illustrated as being the same as the pulleys 43 and 44 and the belt 45.

A first pipe 47 extends from one side portion of the rotor casing 39 and is connected to the air cleaner box 22. Therefore, an inner space of the supercharger 21 and an inner space of the air cleaner box 22 communicate with each other through the first pipe 47. A second pipe 48 extends from the other side portion of the rotor casing 39 and is connected to an air-intake port (not shown) of the engine E. Therefore, the inner space of the supercharger 21 and an inner space of a combustion chamber (not shown) of the engine E communicate with each other through the second pipe 48.

In the supercharger 21, upon the engine E starting, thereby causing the propeller shaft 11 to rotate, rotation is transmitted from the drive pulley 44 rotating integrally with the propeller shaft 11 to the driven pulley 43 through the belt 45. As a result, the rotors 40 and 41 of the supercharger 21 rotate. Thereby, the air flowing from the air cleaner box 22 into the supercharger 21 through the first pipe 47 is pressurized by rotation of the rotors 40 and 41 and is delivered to the combustion chamber of the engine E through the second pipe 48.

In the personal watercraft configured as described above, the mechanically driven supercharger 21 can inhibit occurrence of the turbo lag and reduction of the propulsion force even when the watercraft frequently jumps out of the water and lands in the water. Since the supercharger 21 is provided independently of the engine E, it is not necessary to change design of the engine E or the like to install the supercharger 21, and commercially available supercharger 21 can be used. Further, since the supercharger 21 is located away from the engine E, vibration generated in one of the supercharger 21 and the engine E is less likely to be transmitted to the other.

Since the rotor shaft 42 of the supercharger 21 is placed in parallel with the propeller shaft 11, rotation of the propeller shaft 11 can be transmitted to the rotor shaft 42 by means of a simple configuration using the pulleys 43 and 44, and the belt 45. Therefore, it is possible to gain a high power engine easily and at a low cost.

While it is generally difficult to generate a large torque in a low speed range in the engine using the turbo charger, the engine using the mechanically driven supercharger can generate a relatively large torque in the low speed range. Therefore, in the personal watercraft equipped with the supercharger 21, a relatively large torque can be generated and planing capability of the watercraft can be improved even while the engine E is running at a low speed.

The supercharger 21 is placed on the shaft casing 20 behind the engine E in this embodiment. Alternatively, the supercharger 21 may be placed forward of the engine E. In this case, the crankshaft 9 may be extended forward and the drive pulley is provided on this extended portion to be connected to the driven pulley on the supercharger 21 side by means of the belt. Instead of extending the crankshaft 9, another extended shaft may be coupled to the front end portion of the crankshaft 9. In general, behind the engine E, water flowing into the body 1 is scattered by the coupling means 10, whereas, when the supercharger 21 is placed forward of the engine E, it is possible to prevent contact of the water with the supercharger 21.

Figure 4:
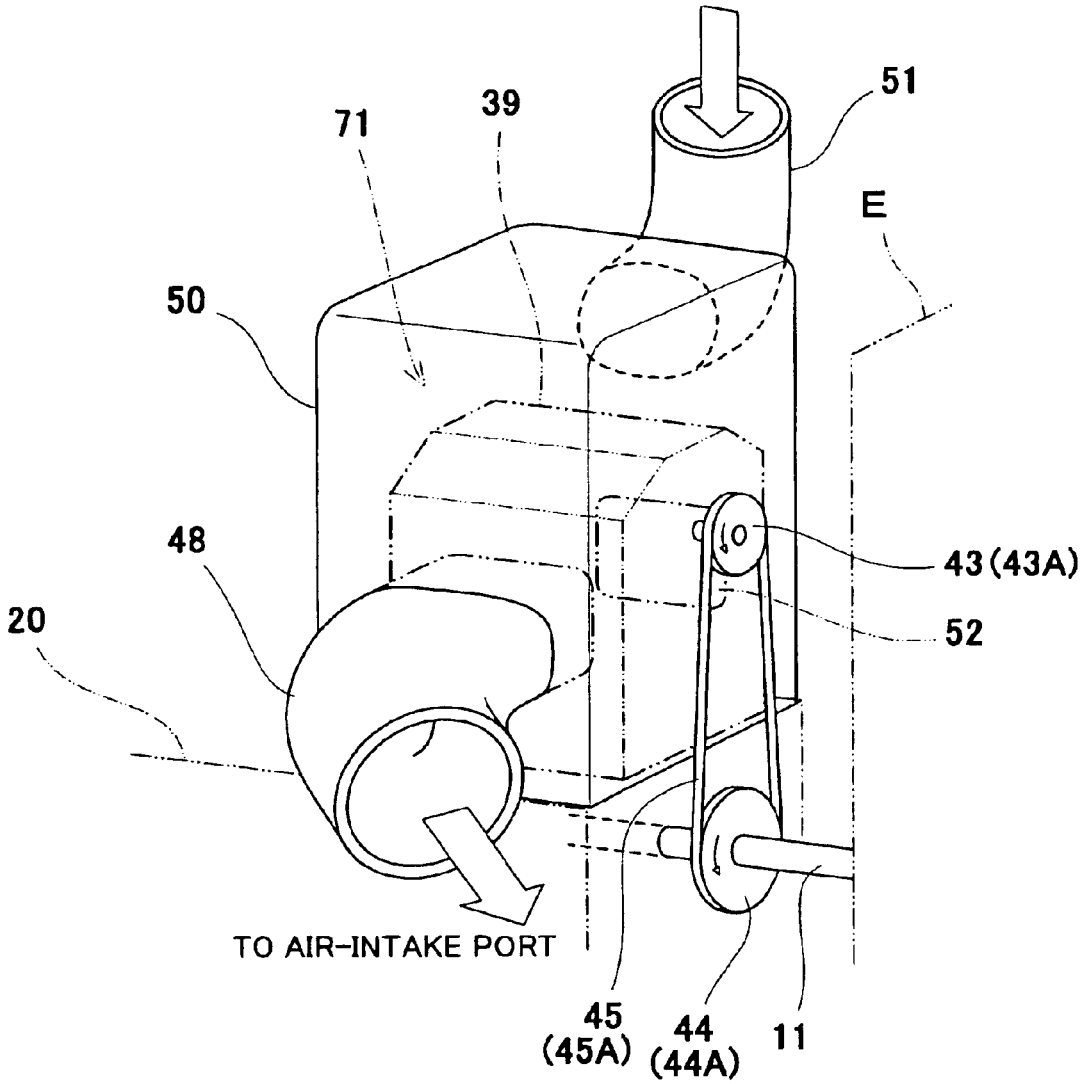
FIG. 4 is a schematic perspective view showing another configuration of the mechanically driven supercharger and its peripheral devices.

In the personal watercraft planing on the water, water often flows into the body 1, and the supercharger 21 generally made of metal is preferably rendered water-proof. A water-proof supercharger 71 is shown in FIG. 4. Hereinbelow, the configuration of the supercharger 71 in FIG. 4 will be described in terms of difference between the supercharger 71 in FIG. 4 and the supercharger 21 in FIG. 3.

In the configuration in FIG. 4, an air cleaner box (air-intake box) 50 is placed on the front side of the upper face of the shaft casing 20 that covers the propeller shaft 11. An air-intake pipe 51 is attached to one side wall portion of the air cleaner box 50 to draw the air into the air cleaner box 50. And, the supercharger 71 is contained within the air cleaner box 50.

In the supercharger 71 in FIG. 4, although the first pipe 47 in FIG. 3 is not provided on one side portion of the rotor casing 39, an opening 52 through which the air is taken in is formed therein. And, the second pipe 48 connected to the other side portion of the rotor casing 39 penetrates the other side wall portion of the air cleaner box 50 and extends outside to be connected to the air-intake port (not shown) of the engine E. In FIG. 4, the same reference numerals as those in FIG. 3 denote the same or corresponding parts.

When the engine E is activated, the supercharger 71 is driven in cooperation with the rotation of the propeller shaft 11, thereby allowing the air to be drawn into the air cleaner box 50 through the air-intake pipe 51. The taken-in air flows through a filter element (not shown) provided within the air cleaner box 50 to allow unwanted substances to be removed, and delivered to the supercharger 71 through the opening 52. The air taken into the supercharger 71 is pressurized and drawn to the combustion chamber of the engine E through the second pipe 48.

Since the supercharger 71 is contained within the air cleaner box 50, the water flowing into the body 1 is inhibited from coming in contact with the supercharger 71. While the filter element is provided within the air cleaner box 50 in this embodiment, the filter element may be provided outside the air cleaner box 50. Also, the filter element may be omitted.

In the configuration in FIGS. 3 and 4, the independent drive pulley 44 (or sprocket 44A) is provided on the propeller shaft 11, but this is only illustrative.

Figure 5:
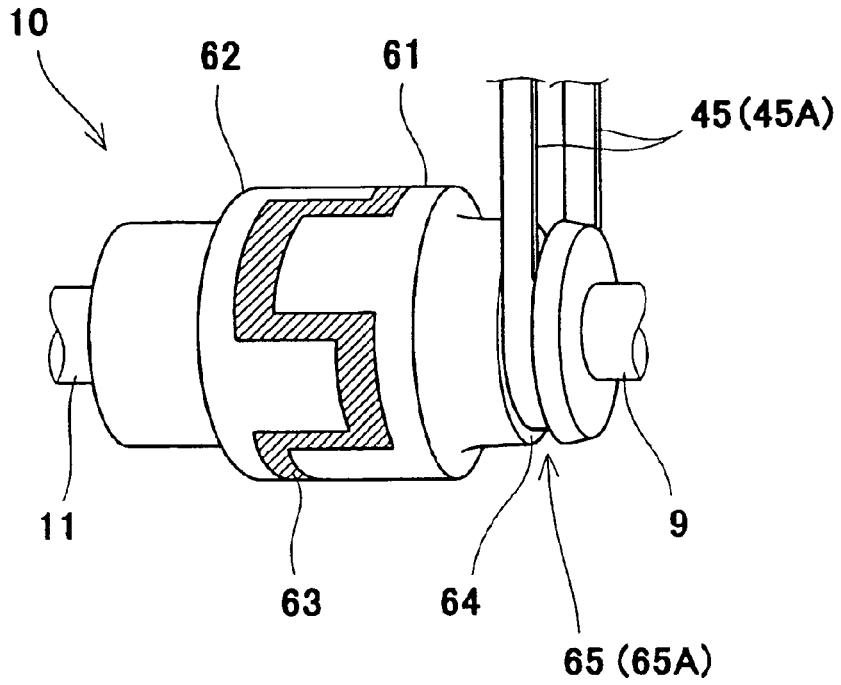
FIG. 5 is a perspective view showing a configuration of a pulley integral with a coupling means.

As shown in FIG. 5, the coupling means 10 comprises a joint 61 connected coaxially to a rear end of the crankshaft 9 and a joint 62 connected coaxially to a front end of the propeller shaft 11. The joints 61 and 62 are each cylindrical with a step portion and are placed coaxially with each other. Larger-diameter portions of the joints 61 and 62 are opposed to each other. The opposed portions of the joints 61 and 62 are formed to have concave and convex portions to engage with each other and are connected to each other through a rubber damper 63 disposed between them. Under this condition, the rotation of the crankshaft 9 is transmitted to the propeller shaft 11.

A groove 64 is formed on an outer peripheral portion of a small-diameter portion of the joint 61. The groove 64 forms a drive pulley 65. The belt 45 is installed around the groove 64 and the pulley 43 on the supercharger 21 side in FIG. 3 or 4. Instead of this belt drive, chain drive is achieved by replacing the pulleys 65 and 43 by sprockets 65A and 43A around which the chain 45A is installed.

In the above structure, an independent pulley need not be provided on the crankshaft 9 or the propeller shaft 11 side, and part of the coupling means 10 serves as the pulley 65. As a result, the number of components can be reduced, and attachment of the independent pulley can be omitted.

A groove may be formed on the joint 62 on the propeller shaft 11 side instead of the joint 61 on the crankshaft 9 side. Furthermore, alternative configuration may be adopted for the coupling means 10 to transmit the rotation of the crankshaft 9 to the propeller shaft 11.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalents of such metes and bounds thereof are therefore intended to be embraced by the claims.

What is claimed is:

1. A personal watercraft comprising:

a body formed by a hull and a deck covering the hull from above, the body having an engine room defined by the hull and the deck;

an engine accommodated in the engine room;

a water jet pump disposed rearward of the engine in a longitudinal direction of the body and configured to be driven by the engine;

a mechanically driven supercharger provided spaced apart from the engine and configured to draw air taken in from the engine room, wherein the supercharger is mounted to the body within the engine room.

2. The personal watercraft according to claim 1, further comprising:

an air-intake box provided within the engine room and having an inner space communicating with the engine room, the air-intake box being configured to store the air to be drawn to the engine, wherein the supercharger is contained within the air-intake box, and configured to suction air within the engine room through the inner space within the air-intake box.

3. The personal watercraft according to claim 1, wherein the supercharger is placed rearward of the engine in a longitudinal direction of the body, the personal watercraft further comprising:

a transmission mechanism configured to transmit power of an output shaft of the engine to a pump shaft of the water jet pump, the transmission mechanism including a transmission shaft connected to the pump shaft and a coupling means configured to couple the output shaft of the engine to the transmission shaft; and a drive mechanism associated with the supercharger, the drive mechanism being configured to connect the supercharger and the transmission mechanism to allow power to be transmitted between the supercharger and the transmission mechanism.

4. The personal watercraft according to claim 3, wherein the supercharger has a rotor shaft for driving a built-in rotor of the supercharger, the rotor shaft is placed to extend substantially in parallel with the transmission shaft, and the drive mechanism includes pulleys respectively provided on the shafts and a belt installed around the pulleys, through which the rotor shaft and the transmission shaft are connected to each other.

5. The personal watercraft according to claim 3, wherein the supercharger has a rotor shaft for driving a built-in rotor of the supercharger, the rotor shaft is placed to extend substantially in parallel with the transmission shaft, and the drive mechanism includes sprockets respectively provided on the shafts and a chain installed around the sprockets, though which the rotor shaft and the transmission shaft are connected to each other.

6. The personal watercraft according to claim 3, wherein the supercharger has a rotor shaft for driving a built-in rotor of the supercharger, the rotor shaft is placed to extend substantially in parallel with the transmission shaft, the drive mechanism includes a driven pulley provided at an end portion of the rotor shaft, a drive pulley provided integrally with on the coupling means, and a belt installed around the pulleys, through which the rotor shaft and the transmission mechanism are connected to each other.

7. The personal watercraft according to claim 3, further comprising:

a coupling means configured to couple an output shaft of the engine to a pump shaft of the water jet pump, wherein the supercharger has a rotor shaft for driving a built-in rotor of the supercharger, the rotor shaft is placed to extend substantially in parallel with the transmission shaft, the drive mechanism includes a driven sprocket provided at an end portion of the rotor shaft, and a drive sprocket provided integrally with the coupling means, and a chain installed around the drive sprocket and driven sprocket, through which the rotor shaft and the transmission mechanism are connected to each other.

8. The personal watercraft according to claim 3, further comprising a shaft casing that covers part of the transmission shaft within the engine room of the watercraft, the shaft casing being extended from an inner wall face of the hull so as to enclose the transmission shaft, wherein the supercharger is placed on the shaft casing such that a rotational shaft of the supercharger is parallel with the transmission shaft.

9. The personal watercraft according to claim 1, wherein the engine is placed such that a crankshaft thereof extends along a longitudinal direction of the watercraft, and has an extended shaft which is extended forward from the crankshaft so as to rotate in cooperation with the crankshaft, and the supercharger is placed forward of the engine in the longitudinal direction and connected to the extended shaft through a drive mechanism of the supercharger, the supercharger being configured to be driven by power transmitted from the extended shaft through the drive mechanism.

10. The personal watercraft according to claim 1, wherein the engine is a four-cycle engine.

* * * * *